US005439629A

United States Patent [19]

Heintz et al.

[11] Patent Number: 5,439,629

[45] Date of Patent: Aug. 8, 1995

[54] METHOD AND APPARATUS FOR PRODUCING PREFABRICATED COMPONENTS FROM PRETENSIONED PRESTRESSED CONCRETE

[75] Inventors: Joachim Heintz, Graefelfing; Peter Auer, Ottobrunn; Helmut Lieske; Peter Plica, both of Munich, all of Germany

[73] Assignee: Dyckerhoff & Widmann Aktiengesellschaft, Munich, Germany

[21] Appl. No.: 133,061

[22] PCT Filed: Feb. 8, 1993

[86] PCT No.: PCT/EP93/00289

§ 371 Date: Dec. 23, 1993

§ 102(e) Date: Dec. 23, 1993

[87] PCT Pub. No.: WO93/15889

PCT Pub. Date: Aug. 19, 1993

[30] Foreign Application Priority Data

Feb. 11, 1992 [DE] Germany ..... 42 03 895.2

[51] Int. Cl.[6] ..... B28B 1/16

[52] U.S. Cl. ..... 264/228; 249/86; 264/229; 264/277; 425/111; 425/122; 425/123; 425/125; 425/289

[58] Field of Search ..... 264/228, 229, 277, 275, 264/279, 279.1; 425/111, 122, 123, 125, 289; 249/86

[56] References Cited

U.S. PATENT DOCUMENTS

| | | | |
|---|---|---|---|
| 2,394,227 | 2/1946 | Barber | 264/228 X |
| 3,504,066 | 3/1970 | Baker | 264/228 X |
| 3,827,132 | 8/1974 | Bratchell . | |
| 4,201,711 | 5/1980 | Thomsen et al. | 264/228 X |
| 4,240,776 | 12/1980 | Black | 425/111 |
| 4,249,873 | 2/1981 | Feuillade | 264/228 X |
| 4,421,710 | 2/1983 | Brocoman | 264/228 |
| 4,522,367 | 6/1985 | Thim | 264/228 X |
| 4,952,129 | 8/1990 | Fan | 264/228 X |

*Primary Examiner*—Karen Aftergut
*Attorney, Agent, or Firm*—Friedrich Kueffner

[57] ABSTRACT

A method for the manufacture of pretensioned prestressed concrete sleepers wherein, the tensioning wires are taken directly from one or more rolls of wire and are introduced in a longitudinal feed into a tensioning frame, and the tensioning wires (5) are initially anchored at the end thereof located at the front in feed direction. The wires are tensioned by a tensioning device arranged outside of the tensioning frame and resting against the opposite end thereof, and the wires (5) are anchored at the tensioning device; only then are the wires severed by means of a severing device. In this manner, it is possible to combine in a single station the operating stages of cutting to length, introducing and tensioning the wires, which stages in the past were distributed over several manufacturing stations, so that the labor intensive and time consuming manipulation of wires which have been previously cut to length is eliminated.

12 Claims, 5 Drawing Sheets

(B)

METHOD AND APPARATUS FOR PRODUCING PREFABRICATED COMPONENTS FROM PRETENSIONED PRESTRESSED CONCRETE

BACKGROUND OF THE INVENTION

1. Field of the Invention

The invention relates to a method of manufacturing precast components from pretensioned prestressed concrete, particularly of prestressed concrete sleepers, and to an apparatus for carrying out the method.

2. Description of the Related Art

Prestressed concrete sleepers in the form of precast concrete components are particular mass-produced articles, wherein the most important consideration is to reduce the manufacturing costs, while at least maintaining, but if possible improving, their quality. This can be achieved either by reducing the material used for the sleepers, or by reducing the manufacturing costs, whether in respect to the equipment provided for the manufacture, or in respect to the work hours required.

In a known prestressed concrete sleeper, the reduction of material used for the sleeper itself is of particular importance, wherein the reinforcement of the monolithic sleeper body is composed of individual tensioning elements in the form of steel rods, steel wires or steel strands which intersect in the center of the sleeper in a vertical plane and from there extend radially in a straight line towards the sleeper ends (DE 38 32 504 A1). By using individual straight tensioning elements and because of the radial extension of the tensioning elements from the center of the sleeper, it is possible in this known sleeper to achieve uniform distribution of the end anchorings over the cross-sectional surfaces of the sleeper ends and a good penetration of the sleeper body with prestressing steel, even if the sleeper ends are wide and the central part is slender; this makes it possible to achieve a high prestressing force without requiring additional untensioned reinforcements. Together with the lower bending moments in the slender central part of the sleeper, these measures result in a substantial reduction in the amount of steel required for the prestressed concrete sleeper.

This known prestressed concrete sleeper can be manufactured either with prestressing against the hardened concrete and with post-tensioning, or in the prestressing bed, i.e., with pretensioning. If the sleepers are produced in the prestressing bed in which the individual tensioning wires are anchored at their ends by adhesion bonding, it is possible to avoid the expense for the anchoring members of the individual tensioning elements which have to be tensioned against the hardened concrete. This expense is sometimes considerable and is incurred, for example, in post-tensioned prestressed concrete sleepers.

Pretensioned prestressed concrete sleepers are usually produced in a long prestressing bed. When manufacturing prestressed concrete sleepers in a long prestressing bed, the tensioning wires are initially put in place, the tensioning wires are tensioned against fixed end abutments and are set in concrete in the tensioned condition. Depending on the length of the prestressing bed or sleeper, it is necessary to provide a large number of formworks which must be arranged on the prestressing bed. The tensioning wires are released from their anchorings or are severed between the individual sleepers only after complete hardening of the sleeper body, so that the tensioning force introduced into the tensioning wires as a tensile force is transmitted to the sleepers as a pretensioning force.

Instead of guiding the tensioning wires over the entire length of a prestressing bed and anchoring the wires only at the ends of the prestressing bed, it is also known that the tensioning wires, which respectively embrace one or more sleepers next to each other or one behind the other, are tensioned against so-called steel tensioning frames and are set in concrete in this condition. For this purpose, appropriately designed formworks must be combined with the tensioning frames (DE 39 31 201 C1). Since the tensioning force of the tensioning wires is in this case built up with respect to the tensioning frames, there is the advantage that the formworks can be recovered relatively early by way of immediate demolding, while the prestressing forces have to be transmitted to the sleepers only after complete hardening of the individual sleepers.

In this known method, the tensioning wires are initially cut to length, the wires are then introduced into the tensioning frames and are tensioned relative to the latter by means of a tensioning device integrated into the tensioning frames. These steps of operation necessarily have to be performed at different work stations, so that the work required for these work steps is comparatively substantial.

SUMMARY OF THE INVENTION

Against this background, it is the object of the invention, in the manufacture of pretensioned prestressed concrete sleepers using tensioning frames, to provide an economical manner of operation, and particularly to improve, especially simplify and accelerate, the procedures of introducing the tensioning wires into the tensioning frames and the tensioning operation itself.

In accordance with the invention, this object is met by a method of manufacturing precast components of pretensioned prestressed concrete, particularly prestressed concrete sleepers, wherein the tensioning wires are taken from one or more wire rolls and immediately inserted in a longitudinal feeding procedure into a tensioning frame and are initially anchored at one end of the tensioning frame. The tensioning wires are then tensioned by means of a tensioning device which is arranged outside of the tensioning frame and rests against the opposite end of the tensioning frame. The tensioning wires are then anchored at the opposite end of the tensioning frame and are only then severed from the wire roll. Finally, formworks are moved over the tensioned tensioning wires and concrete is cast into the formworks and, after hardening of the concrete, the tensioning wires are separated from the tensioning frame.

The apparatus for carrying out the above-described method includes at least one tensioning frame and anchoring devices arranged at the tensioning frame for the tensioning wires. A tensioning device is provided for tensioning the tensioning wires. A feed device for the insertion of the tensioning wires taken from one or more wire rolls into the tensioning frame and a severing device for the tensioning wires are arranged in front of a support device for a level support of a tensioning frame. A tensioning device for tensioning the tensioning wires is provided for the support device, wherein the tensioning device is arranged outside of the tensioning frame and rests against the tensioning frame.

The basic concept of the invention resides in that the tensioning wires, which are wound directly from one or more rolls of wire, are introduced into the tensioning frame, are tensioned and only then cut to length. Accordingly, the work steps, such as cutting to length, introducing the wires and tensioning the wires, which in the past were distributed over several manufacturing stations, are now combined in a single station; the manipulation of the individual wires which have been previously cut to length, which is cumbersome and also labor and time intensive, is omitted. However, to achieve this, a requirement is that, when a reinforcement is composed of several tensioning wires, a roll of wire is provided for each of the tensioning wires, so that all tensioning wires can be introduced into the tensioning frame in a single feeding step.

Since the tensioning device acts directly on the tensioning wires, it is possible to omit the previously necessary displaceable wire anchorings at the tensioning side of each tensioning frame; they are replaced by a simple fixed anchoring. This also results in lower initial costs. A particularly advantageous effect which, in turn, also saves time, is achieved by the use of known clamping anchors for the tensioning wires both at the tensioning frame and at the tensioning device.

The introduction of the tensioning wires into the tensioning frame, particularly in the case of intersecting wires, for example, in a prestressed concrete sleeper of the above-described type, can be significantly facilitated and accelerated by a wire guiding device which includes a number of guide channels for a tensioning wire each, wherein the guide channels permit a simultaneous, orderly and sag-free insertion of all wires, both in the case of tensioning wires which extend parallel and in the case of intersecting tensioning wires for prestressed concrete sleepers. This not only eliminates the usually necessary rearrangement of the tensioning wires after the wires have been drawn in; since the tensioning wires do not sag or at least all sag to the same extent, prestressing can be applied simultaneously and in one pulling operation.

The application of this device is not limited to tensioning frames. Such a wire guiding device can also be used in types of manufacture in which the tensioning wires are inserted into a sleeper mold and are tensioned relative to the mold.

BRIEF DESCRIPTION OF THE DRAWINGS

The invention will be explained in more detail below with the aid of the drawing. In the drawing FIG. 1 schematically shows the configuration of a prestressed concrete sleeper with tensioning wires which partly extend parallel to each other and partly intersect one another.

DESCRIPTION OF THE PREFERRED EMBODIMENTS

FIGS. 1–4 illustrate, in each case schematically, an embodiment of the configuration of the sleeper body 1 of a pretensioned prestressed concrete sleeper and the guiding of the prestressing reinforcement, as it can be positioned and tensioned in accordance with the method and by means of the apparatus according to the invention. In the illustrated embodiment, the sleeper body 1 is composed of two comparatively wide lateral support bodies 2 and 3 which support the rail mounting, not shown for clarity's sake, and a central part 4 having a comparatively narrow tall cross-section. The prestressing reinforcement includes eight straight tensioning wires 5 which, to make their paths clearly evident, are additionally designated by a to h.

Figure 1:
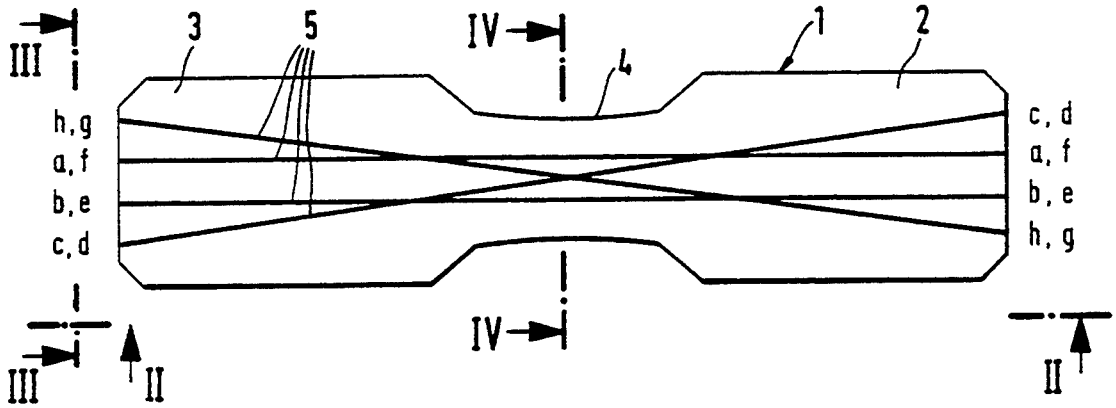
Figure 2:
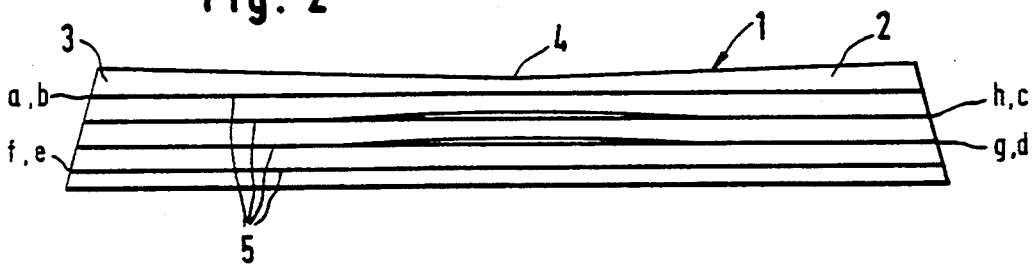
FIG. 2 is a side view of the prestressed concrete sleeper.
Figure 3:
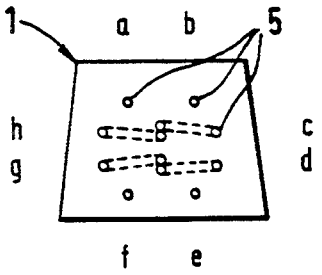
FIG. 3 is a front view of the prestressed concrete sleeper in direction III—III.
Figure 4:
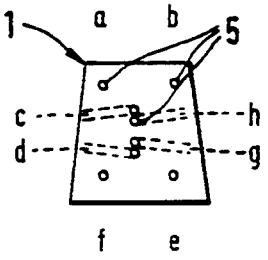
FIG. 4 is a cross-section along line IV—IV in FIG. 1.

The prestressing reinforcement is composed of two pairs of tensioning wires a and b or e and f which extend through the sleeper body 1 parallel to the longitudinal axis thereof, and two additional pairs of tensioning wires c and d or g and h which intersect in the center axis of the sleeper body 1. The end anchorings of the tensioning wires 5 produced by adhesion bonding are uniformly spaced apart at the ends of the sleeper over the cross section thereof (FIG. 3); in the center axis of the sleeper body 1, the tensioning wires 5 are heavily concentrated in a vertical axis (FIG. 4). Of course, in addition to this mixed configuration of parallel and intersecting tensioning wires, which makes possible a relatively wide support body 2, 3 and a slender central part 4 of the sleeper body 1, other embodiments are conceivable and can be realized in accordance with the method as well as in accordance with the apparatus according to the invention, wherein the additional embodiments are composed exclusively of parallel tensioning wires, and also reinforcements which are composed exclusively of tensioning wires which intersect in the center axis.

Figure 5:
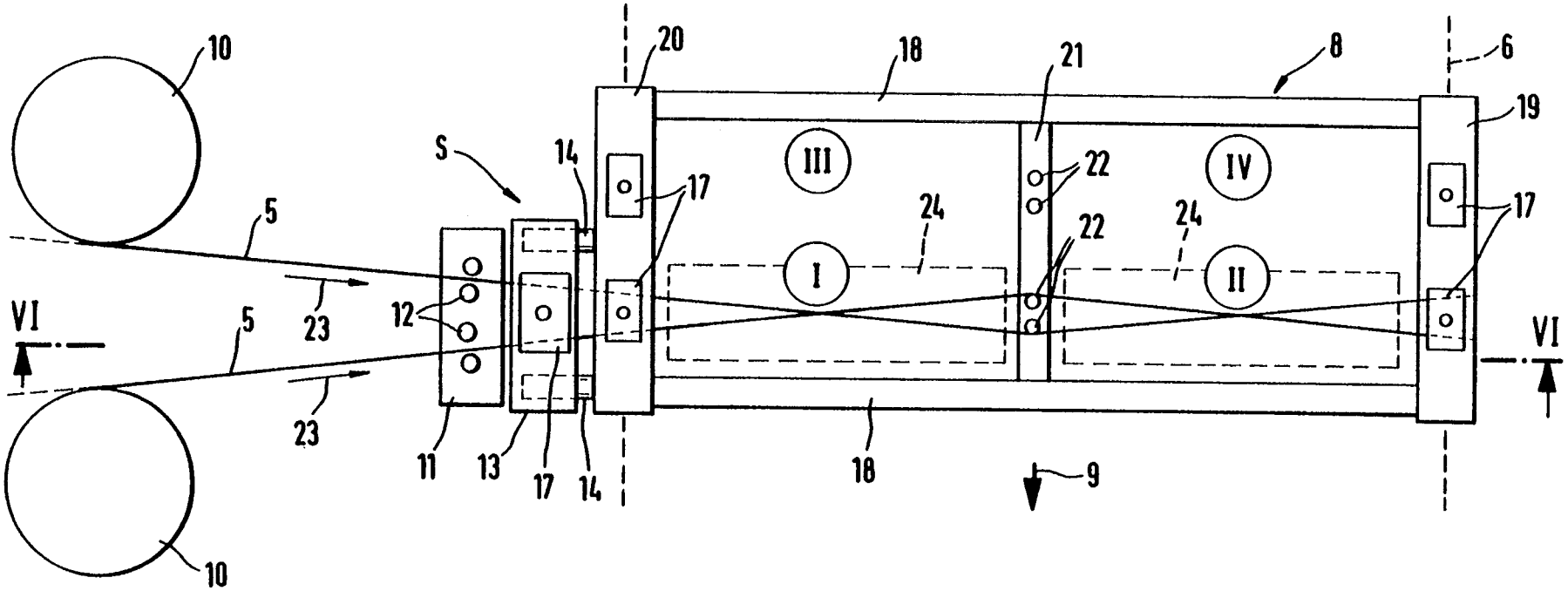
FIG. 5 is in a schematical illustration a top view and FIG. 6 is a side view of an apparatus according to the invention.
Figure 6:
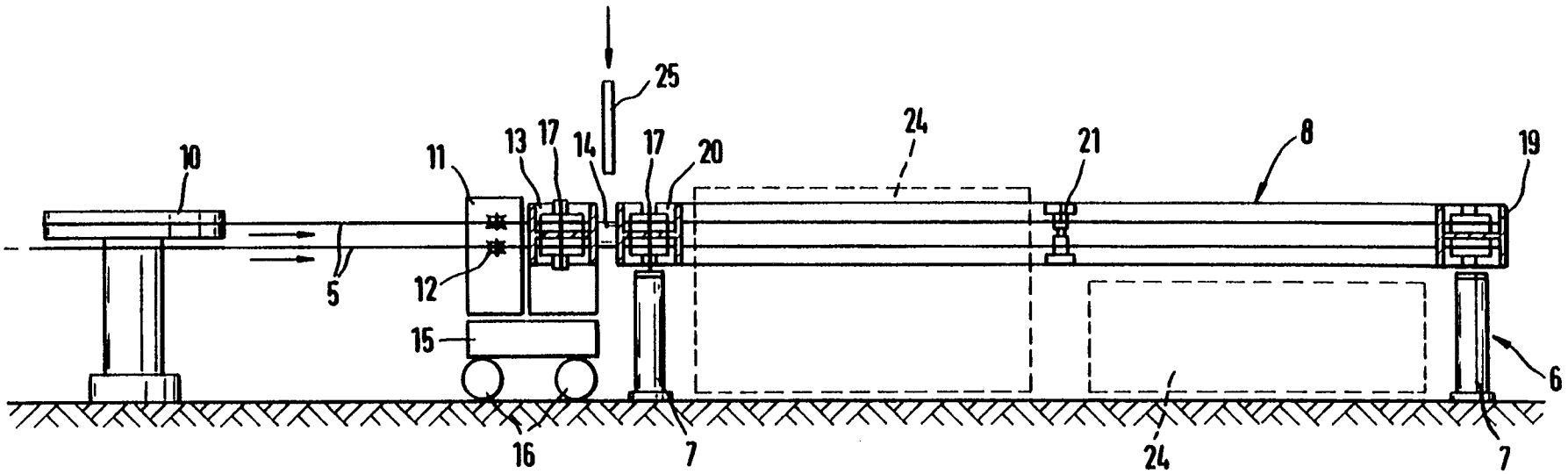

In order to make it possible to manufacture a pretensioned prestressed concrete sleeper of the above-described configuration, the tensioning wires 5 initially must be placed in a position with respect to each other resulting in the desired reinforcement, the wires must be tensioned in this position and retained inside a formwork until the concrete in which the tensioning wires are to be embedded, is poured into the formwork, is compacted and has hardened. In accordance with the invention, this is effected by means of a tensioning frame and by means of an apparatus which is schematically illustrated in FIGS. 5 and 6.

The apparatus according to the invention includes a feed path 6 which extends over rows of supports 7 and along which a number of tensioning frames can be advanced in the direction of arrow 9; however, only one of the tensioning frames 8 is illustrated. In the simplest case, one support structure is sufficient for one tensioning frame if the tensioning frame is advanced in a different manner.

A station S is formed along the feed path 6, wherein the tensioning wires 5 are fed to the station S and are placed in their positions in the tensioning frame 8. A wire supply with a number of wire rings 10 is arranged laterally of the station S, wherein the number of wire rings 10 corresponds to the number of individual tensioning wires of which the respective reinforcement is composed. Only two wire rings 10 are illustrated in FIG. 5; additional wire rings are arranged adjacent in an outward direction.

A feed device 11 for the tensioning wires 5 is provided for the station S. The feed device 11 also has a number of driven roller pairs 12 corresponding to the number of wires, as well as a tensioning device 13 which rests with two tensioning cylinders 14 in a bridge-like manner relative to the tensioning frame 8. The feed device 11 and the tensioning device 13 are combined in a unit and arranged on a carriage 15 which can travel on rollers 16 in the direction of the axis of symmetry of the reinforcement to be produced, so that the elongation of the wires occurring during tensioning can be compensated. The tensioning device 13 is equipped with a known clamping device 17 by means of which the tensioning wires 5 extending between the clamping plates can be fixed in a clamping manner and by a single lifting movement and can again be released.

The tensioning frame 8 is composed of a rectangular frame with two lateral longitudinal support members 18, a front end transverse support member 19 and a rear end cross support member 20, as well as a central transverse support member 21. The tensioning frames 8 are of steel construction, preferably formed from rolled sections. The tensioning frame illustrated in FIGS. 5 and 6 includes four positions I to IV, in each of which a prestressed concrete sleeper can be manufactured. In accordance with these positions, clamping anchorings 17 are arranged in the area of the end transverse support members 19 and 20, wherein the clamping anchoring 17 correspond to those at the tensioning device 13. Rollers 22 for deflecting the intersecting tensioning wires are disposed on the central transverse support member 21.

The method according to the invention is carried out with this apparatus as follows:

A number of tensioning frames 8 are guided along the feed path 6 in a horizontal direction to the wire feeding and tensioning station S illustrated in the drawing. As soon as a tensioning frame 8 has reached the position illustrated in FIG. 5, the tensioning wires 5 are advanced from the wire rings 10 by means of the feed device 11 in the direction of arrows 23 and placed in the positions I and II required for the respective reinforcement.

A wire guiding device 24, of which two like units are arranged one behind the other in the direction of the axis of reinforcement, serves to position the individual tensioning wires 5. The wire guiding devices 24 can be moved into the plane of the tensioning frames 8 and removed from this plane by a vertical lifting movement. In accordance with FIG. 6, the left-hand unit of this wire guiding device 24, which will be explained in more detail with the aid of FIGS. 7–10, is raised into the plane of the tensioning frames 8 while the right-hand unit is shown in the lowered state.

In the lowered position of the wire guiding devices 24, always one tensioning frame 8 can be inserted horizontally into the station S. The two wire guiding devices 24 are then raised into the positions I and II of the tensioning frame 8. Subsequently, the tensioning wires 5 are introduced and initially anchored at the front end transverse support member 19 by means of the clamping anchoring 17. The tensioning wires 5 are then tensioned by means of the tensioning device 13 and are also anchored by the clamping anchoring 17 at the rearward end transverse support member 20. Subsequently, the wires 5 are severed by means of a wire severing device 25 and the clamping anchoring 17 at the clamping device 13 is released. During the next step of operation, the tensioning frame 8 is conveyed further in feed direction (arrow 9) until the positions III and IV in the station S are located above the wire guiding device 24. At these positions, the tensioning wires 5 are then introduced, tensioned and anchored in the same manner.

The tensioning frame 8, having been provided in this manner with tensioned tensioning wires 5, is then conveyed further in feed direction (arrow 9). The tensioning frame 8 is then brought together with the formworks which are moved over the tensioned tensioning wires 5 and into which finally the concrete can be poured. By way of an immediate demolding process, the formworks can already be removed before the concrete has fully hardened. The tensioning frames are initially left in their position with respect to the freshly produced sleepers until the concrete has completely hardened and the prestressing force can be transmitted to the sleeper body by releasing the clamping anchorings 17. Subsequently, the tensioning frames 8 are cleaned, if necessary, and are conveyed along the feed path for reuse.

Figure 7:
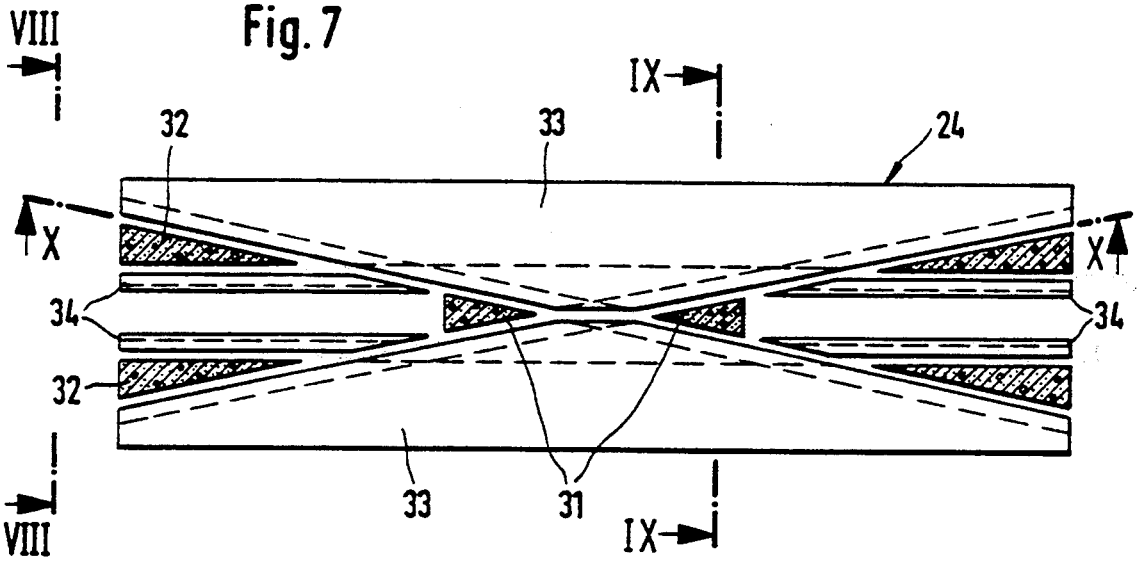
FIG. 7 is a top view of a wire guiding device in the closed state.
Figure 8A:
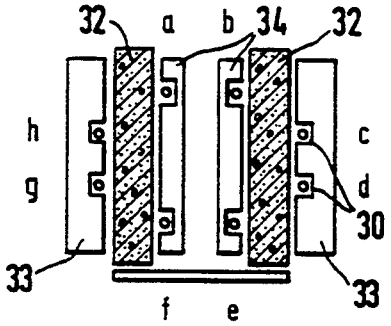
FIGS. 8*a* and 8*b* are front views along line VIII—VIII of FIG. 7 of the wire guiding device in the closed state and opened state, respectively.
Figure 8B:
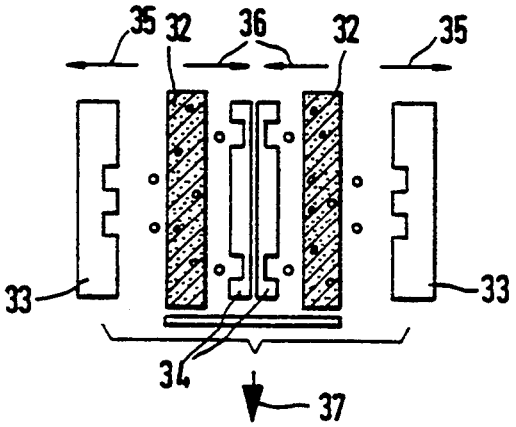
Figure 9A:
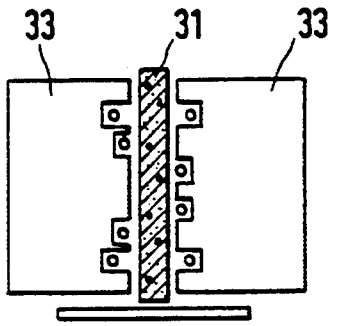
FIGS. 9*a* and 9*b* are cross-sections along line IX—IX in FIG. 7 of the wire guiding device in the closed state and opened state, respectively.
Figure 9B:
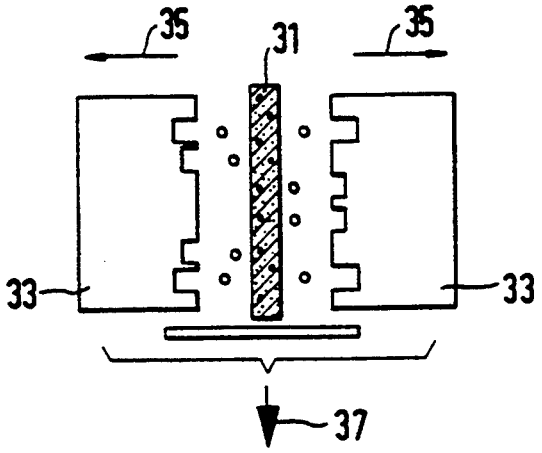
Figure 10:
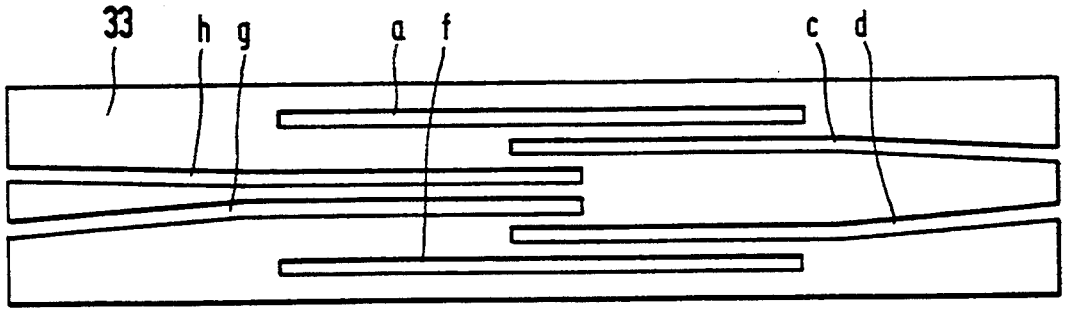
FIG. 10 is a side view along line X—X in FIG. 7 of a movable outer part of the wire guiding device.

A wire guiding device 24 is illustrated in a top view in FIG. 7 and in additional views and cross sections in FIGS. 8–10. The wire guiding device 24 serves to position the tensioning wires 5 to form a reinforcement, as provided for a prestressed concrete sleeper according to FIGS. 1–4. This configuration of reinforcement is chosen only as an example in order to explain the wire guiding device 24; of course, the wire guiding device 24 according to the invention can also be used analogously for other configurations of reinforcement.

The wire guiding device 24 is composed of a number of partly fixed, partly movable components, wherein always two of these components form, in the closed state illustrated in FIGS. 7 and **8*a* as well as 9*a*, guide channels 30 for a tensioning wire 5 each. According to the illustration of the reinforcement symmetrical to the center axis of the sleeper, the device according to FIG. 7 includes two fixed triangular inner parts 31 and always two fixed, also triangular outer parts 32. Cooperating therewith are two movable outer parts 33 and two movable inner parts 34, respectively. While the fixed parts 31 and 32 have flat smooth lateral surfaces, the movable parts 33 and 34 have longitudinal grooves in each of the surfaces facing the fixed parts 31 and 32, respectively, wherein, together with the flat surfaces of the fixed parts 31 and 32, the grooves form closed guide channels 30 (FIGS. 8*a*, 9*a***).

In this closed position, the wire guiding device 24 is raised (FIG. 6), so that the tensioning wires 5 can be easily inserted along the guide channels 30 and arranged in the configuration required for the reinforcement. FIG. **8*a* shows in a front view along line VIII—VIII of FIG. 7 the pattern of reinforcement corresponding approximately to the front view of the sleeper according to FIG. 3. FIG. 9 shows in a sectional view along line IX—IX in FIG. 7 a configuration approximately corresponding to the cross section of FIG. 4**.

As is evident from FIGS. **8*b* and 9*b*, after insertion of the tensioning wires 5, the two movable outer parts 33 are moved outwardly in the direction of arrows 35 and the movable inner parts 34 are moved inwardly in the direction of arrows 36. As a result, the reinforcing wires 5 are released from the guide channels, so that the wire guiding device 24 can be lowered in the direction of arrow 37** before the wires are tensioned and a new step of operation begins at another location.

Finally, FIG. 10 shows the arrangement of the grooves in the inner surfaces of the movable outer parts 33 in a view along X—X in FIG. 7. The upper and lower guide channels serve to guide the parallel wires 30*a* and 30*f*; the central guide channels serve to guide the intersecting wires 30*h* and 30*g* on the left-hand side of the outer part and the wires 30*c* and 30*d* on the right-hand side.

We claim:

1. A method of manufacturing precast components of pretensioned prestressed concrete comprising taking tensioning wires from at least one wire roll and immediately subsequently inserting the tensioning wires by a longitudinal feeding procedure into a tensioning frame, initially anchoring the tensioning wires at a first end of the tensioning frame, subsequently tensioning the tensioning wires by a tensioning device arranged outside of the tensioning frame and resting against a second end of the tensioning frame opposite the first end of the tensioning frame, anchoring the tensioning wires at the second end of the tensioning frame, then severing the anchored tensioning wires from the wire roll, and casting concrete about the tensioning wires in the tensioned state in a formwork moved over the tensioning wires anchored in the tensioning frame, and after hardening of the concrete, separating the tensioning wires from the tensioning frame.

2.The method according to claim 1, wherein the tensioning wires are taken from the at least one wire roll in a feed direction, the first end of the tensioning frame being at the front end in feed direction and the second end of the tensioning frame being at the rearward end in feed direction, and wherein the tensioning wires are severed by means of a severing device arranged between the tensioning frame and the tensioning device.

3. The method according to claim 1, further comprising applying a clamping means to obtain a frictional bonding action for anchoring the tensioning wires relative to at least one of the tensioning frame and the tensioning device.

4. An apparatus for manufacturing precast components of pretensioned prestressed concrete comprising at least one tensioning frame and anchoring devices mounted at the tensioning frame for anchoring the tensioning wires, a feed device for taking the tensioning wires in a feed direction from at least one wire roll and for inserting the tensioning wires into the tensioning frame, a support device for a level support of the tensioning frame, a severing device for severing the tensioning wires arranged in feed direction in front of the support device, the support device comprising a tensioning device for tensioning the tensioning wires, wherein the tensioning device is arranged outside of the tensioning frame and so as to rest against the tensioning frame.

5. The apparatus according to claim 4, wherein the support device constitutes a station arranged along a feed path for tensioning frames, wherein the feed path extends in a horizontal plane.

6. The apparatus according to claim 4, wherein the tensioning device is arranged in front of the support device in feed direction.

7. The apparatus according to claim 4, comprising means for displacing the tensioning device in feed direction of the tensioning wires.

8. The apparatus according to claim 4, wherein the feed device and the tensioning device are mounted as a unit, further comprising means for displacing the unit in feed direction of the tensioning wires.

9. An apparatus for manufacturing precast components of pretensioned prestressed concrete, the apparatus comprising at least one tensioning frame being mounted in a plane and anchoring devices mounted at the tensioning frame for anchoring the tensioning wires, a feed device for taking the tensioning wires in a feed direction from at least one wire roll and for inserting the tensioning wires into the tensioning frame, a support device for a level support of the tensioning frame, a severing device for severing the tensioning wires arranged in feed direction in front of the support device, the support device comprising a tensioning device for tensioning the tensioning wires, wherein the tensioning device is arranged outside of the tensioning frame and so as to rest against the tensioning frame, further comprising at least one wire guiding device with guide channels for inserting the tensioning wires into the tensioning frame, the at least one wire guiding device being arranged in a region of the support device, and means for vertically displacing the wire guiding device into the plane of the tensioning frame for facilitating the insertion of the tensioning wires and for moving the wire guiding device out of the plane of the tensioning frame.

10. The apparatus according to claim 9, wherein the wire guiding device is arranged underneath the feed path for the tensioning frame.

11. The apparatus according to claim 10, wherein the wire guiding device comprises a framework with guide channels which are positioned in accordance with a predetermined spatial position of the tensioning wires producing a spatial reinforcement and for receiving the tensioning wires at one end thereof, the guide channels comprising joints extending in longitudinal direction, wherein the guide channels are adjustable from a closed position allowing guidance of the tensioning wires during feeding by opening the joints into an open position allowing removal of the framework from an area of the spatial reinforcement.

12. The apparatus according to claim 11, wherein the guide channels are defined by substantially longitudinally extending grooves in lateral surfaces of first components, wherein, for opening and closing the guide channels, the first components are displaceable transversely of a longitudinal axis of the spatial reinforcement relative to second fixed components with flat surfaces extending parallel to the longitudinal axis.

* * * * *